US005192096A

United States Patent [19]

Weinerman et al.

[11] Patent Number: 5,192,096

[45] Date of Patent: Mar. 9, 1993

[54] DOOR LOCK ASSEMBLY

[75] Inventors: Lee S. Weinerman, Medina; John V. Pastva, Jr., Parma Hts.; Steven A. Mayo, Akron, all of Ohio

[73] Assignee: The Eastern Company, Cleveland, Ohio

[21] Appl. No.: 802,204

[22] Filed: Dec. 4, 1991

Related U.S. Application Data

[63] Continuation-in-part of Ser. No. 665,982, Mar. 7, 1991, and a continuation-in-part of Ser. No. 666,404, Mar. 7, 1991, and a continuation-in-part of Ser. No. 666,793, Mar. 8, 1991.

[51] Int. Cl.[5] ..... E05C 3/34

[52] U.S. Cl. ..... 292/45; 70/130

[58] Field of Search ..... 70/130; 292/27, 45, 292/49, 140

[56] References Cited

U.S. PATENT DOCUMENTS

| | | | |
|---|---|---|---|
| D. 231,723 | 6/1974 | Pastva, Jr. | D8/109 |
| 1,977,853 | 10/1934 | Kemp | 70/103 X |
| 1,983,446 | 12/1934 | Falk | 70/103 |
| 3,532,373 | 10/1970 | Poe | 292/53 X |
| 3,857,594 | 12/1974 | Pastva, Jr. | 292/27 |

OTHER PUBLICATIONS

Eberhard Manufacturing Co., division of The Eastern Co., The Eberhard 206 Safety Slam Lock System is more than just a lock, 6 pages, 1978, Cleveland, Ohio 44136.

Eberhard Manufacturing Co., division of The Eastern Co., Series 206,207,208, 4 pages, 1989, Cleveland, Ohio 44136.

Eberhard Manufacturing Co. division of The Eastern Company, Eberhard 206 Safety Slam Lock, Apr. 1973, 4 pages, Cleveland, Ohio USA 44136.

U.S. Pat. & Trademark Office, Supplemental Register Trademark Reg. 1,455,909 Registered Sep. 1, 1987, Washington, D.C. 20231.

*Primary Examiner*—Richard E. Moore

*Attorney, Agent, or Firm*—David A. Burge

[57] ABSTRACT

A door lock assembly includes a housing-carried set of interactive operating components for mounting on a closure for releasingly engaging a keeper that is carried by structure located adjacent to an opening through which access is controlled by positioning the closure selectively in "open" and "closed" positions. The lock assembly is "slam-capable" in that its operating components include a pair of oppositely pivoted, spring-biased latch members that are movable into latching engagement with the keeper as the closure is "closed". The lock assembly has a two-part housing formed from first and second members that extend in congruent overlying relationship to define a first passage for receiving portions of the keeper as the closure is "closed." Second and third passages open through opposed side walls of the first passage to permit the opposed latch members to move into gripping engagement with portions of the keeper that are received within the first passage. A central chamber is defined between interior surfaces of the first and second housing members for positioning and movably mounting the operating components, including portions of the oppositely pivoted latch members and a selected one of a plurality of slide embodiments that utilize stamped metal components. The slide engages the latch members and engages at least one operating member for effecting "unlatching" movement of the latch members in response to operation of an operating member. The novel and improved members from which the housing is formed include a first, relatively thick die cast member that matingly engages a second, relatively thin member formed from stamped metal.

30 Claims, 8 Drawing Sheets

346
302
388
121
120
306
346
384
388
366
388
386
304
386
318
374
316
308
140
330
372
314
312
388
800
308
320
190
688
690
770
790
784
792
688
684
782
786
176
175
790
780
784
770
178
792
174
190
178
570
572
580
688
582
590
690
688
684
594
595
502
596
572
570'
571'
504'
502'
170'
580'
554
554'
550'
170
504
550
544
544'
546'
571'
572'
506
540
530'
552
542
546
506'
550'
552'
522'
521
522
172'
500'
554
530
520
250
554'
542'
520'
550
500
262
252
544'
540'
540'
521'
544
530
295
530'
540
293
288
546'
172
546
521
246
520'
521'
522'
292
296
522
222
520
206
280
202
270
220
226
297
130
292
236
288
110
262
294
264
291
264
246
293
282
250
268
299
288
298
228
252
218
266
294
238
216
212
295
284
179
208
236
238
296
224
204
297
272
195
288
298
264
286
266
228
208
214
486
450
454
299
195
490
452
230
800
150
160
150
160

DOOR LOCK ASSEMBLY

CROSS-REFERENCE TO RELATED APPLICATIONS

The present application is a continuation-in-part of three applications, the disclosures of all three of which are incorporated herein by reference, namely:

DOOR LOCK ASSEMBLY, a utility application of Ser. No. 07/665,982, filed Mar. 7, 1991 by Lee S. Weinerman et al, referred to hereinafter as the "Parent Utility Case;"

LOCK ASSEMBLY, a design application of Ser. No. 07/666,404, filed Mar. 7, 1991 by Lee S. Weinerman et al, referred to hereinafter as the "Parent Design Case;" and, VEHICLE DOOR LOCK ASSEMBLY, a utility application of Ser. No. 07/666,793, filed Mar. 8, 1991 by Lee S. Weinerman et al, referred to hereinafter as the "Related Utility Case."

BACKGROUND OF THE INVENTION

1. Field of the Invention

The present invention relates to a novel and improved slam-capable door lock assembly that includes a housing-carried set of operating components that latchingly engage a keeper as a closure on which the lock assembly is mounted is moved to its closed position. More particularly, the present invention relates to an opposed-jaw type of double-acting lock assembly that has a two-piece housing of novel and improved design, with the housing-carried operating components including a novel and improved slide for concurrently operating a set of spring-biased, oppositely pivoted jaws that latchingly engage a suitably configured keeper.

2. Prior Art

Locks are known that employ pairs of opposed, spring-biased bolts for engaging a keeper. By way of example, reference is made to U.S. Pat. No. 3,857,594 issued Dec. 31, 1974 to John V. Pastva, Jr., entitled DOOR LOCK ASSEMBLY, referred to hereinafter as the "Prior Utility Patent," the disclosure of which is incorporated herein by reference; and to U.S. Pat. No. 231,723 issued Jun. 4, 1974 to John V. Pastva, Jr., entitled VEHICLE DOOR LOCK, referred to hereinafter as the "Prior Design Patent," the disclosure of which is incorporated herein by reference. The Prior Utility Patent discloses mechanical features of one such lock. The Prior Design Patent relates to external appearance features of one such lock.

While the subject matter of the Prior Utility Patent has provided a well-accepted slam-capable door lock that is well suited for use in what are referred to by those who are skilled in the art as "personnel restraint applications" (e.g., locks for passenger compartment doors of vehicles), a need has arisen for a lighter-duty but similarly configured door lock formed from a lesser number of complexly configured components, with the lighter-duty lock being usable in "non-passenger-restraint" types of applications, typically for controlling access to vehicle storage compartments that are not intended to restrain passengers but rather are used typically to house tools, supplies and the like.

3. The Cross-Referenced Parent and Related Cases

The Parent and Related Utility Cases to which reference is made on Page One hereof have in common with the present case the fact that the subjects matter of all of these cases relate to the provision of relatively light-duty lock assemblies that are intended to be used in what are referred to by those who are skilled in the art as "non-personnel restraint" types of applications. Likewise, the subjects matter of all of these cases draw upon features of proven technology of the type that has resulted from experience that has been gained through use of the invention that forms the subject matter of the Prior Utility Patent. Also, the subjects matter of these cases address an existing need to provide reliable lock assemblies that are formed from a minimal number of components that preferably include only a relatively small number of complexly configured components that are used together with components that are formed relatively inexpensively, typically as sheet metal stampings.

The Parent and Related Utility cases each disclose the possibility of substituting, for a one-piece slide, a plural-piece slide assembly that includes interfitted stamped metal components. The plural-piece slide assembly includes one stamped part formed from relatively thick sheet metal, and one stamped part formed from relatively thin sheet metal, with the thinner part having a pair of closely-spaced parallel portions that serve to reinforce a central region of the thicker part -- a region that needs to be able to resist deformation.

The Parent Design Case to which reference is made on Page One hereof discloses appearance features, some of which are used together with some of the appearance features that are disclosed in the Prior Design Patent in the "preferred embodiment" for carrying out the "best mode" known to the inventors for practicing the present invention; however, this is done in order to enhance the appearance of the resulting product, and to incorporate certain of the appearance features that are the subject of U.S. Pat. No. 1,455,909.

SUMMARY OF THE INVENTION

The present invention addresses the need that is described above by providing a novel and improved, slam-capable door lock assembly that includes a housing-carried set of operating components that latchingly engage projecting portions of a suitably configured keeper, with this latching engagement taking place as a closure on which the lock assembly is mounted is moved toward its "closed" position, with the lock assembly including a two-piece housing of novel and improved design, and with the operating components including one of a plurality of novel and improved slide embodiments.

In many respects, lock assemblies that embody the "best mode" and "preferred practice" of the present invention draw from well-proven features of the type of vehicle door lock that constitutes the subject matter of the Prior Utility Patent. Likewise, in many respects, lock assemblies that embody the "best mode" and "preferred practice" of the present invention draw from certain appearance features that constitute the subject matter of the Prior Design Patent. Thus, the combination of features that comprises the claimed invention benefits from features of proven technology.

In other respects, however, the combination of features that comprises the claimed invention includes novel and improved housing and slide components that enable reliable, long-lived, non-passenger-restraint types of door lock assemblies to be formed from a relatively small number of complexly configured components that are assembled with a significant number of relatively simply configured components, including a number of components that are formed relatively inexpensively as stampings of sheet metal.

While a door lock that embodies features of the present invention may incorporate among its housing-carried operating components a one-piece slide member that is formed as a stamping from sheet metal, a feature of the most preferred practice of the present invention resides in the provision of a novel and improved plural-part slide assembly that can be formed relatively inexpensively, and that can be interchangeably substituted for the aforementioned one-piece slide. Preferably the plural-part slide includes first and second component parts which have been formed as inexpensive stampings from sheet metal. The first part preferably is stamped from relatively thick sheet metal. The second part preferably is stamped from relatively thin sheet metal. In most preferred practice, the plural-part slide assembly also includes a third part, namely a rigid block of plastic material.

The component parts of the plural-part slide assembly cooperatively interact to provide a slide that is characterized by such strength and rigidity as are needed to impart good service life to the resulting product. The first, relatively thick stamping has a generally U-shaped form that is defined by a pair of spaced, substantially parallel-extending elongate portions that each have an end which is connected to a transversely extending, integrally-formed leg that defines what will be referred to as a "central region" of the first stamping. The central region desirably will withstand reasonable loadings of force without being deformed. The second, relatively thin stamping has a pair of closely spaced, transversely extending, parallel walls that receive the central region therebetween and snugly engage opposite sides of the central region to provide central-region reinforcement. A selected one of the parallel walls cooperates with other wall portions of the relatively thin stamping to define a "pocket" into which the rigid block of plastic material is snugly fitted. The pocket-mounted block of plastic has a surface that extends along and snugly engages the selected parallel wall to enhance the rigidity of the selected parallel wall (and to thereby enhance such central-region reinforcement as is afforded by the relatively thin stamping to the central region of the relatively thick stamping) Moreover, the rigid block of plastic material also assists in rigidifying and in maintaining the proper functional configuration of major portions of the thinner stamping.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

At the very outset of this description, it is appropriate to emphasize that lock assemblies of the type that embody the "best mode" and the "preferred practice" of the present invention (e.g., such lock assemblies that are designated by the numeral 100 in the description that follows, and in the accompanying drawings) are not intended for, nor are they deemed suitable for use with, what are referred to by those who are skilled in the art as "personnel restraint applications." Stated in another way, lock assemblies that embody the preferred practice of the present invention are not intended for use on vehicle doors that are utilized to confine people in passenger carrying portions of a vehicle. Rather, lock assemblies that embody the preferred practice of the present invention typically are intended for use in controlling access to non-passenger-carrying storage compartments of vehicles, and for other "non-personnel-restraint" types of applications.

Figure 1:
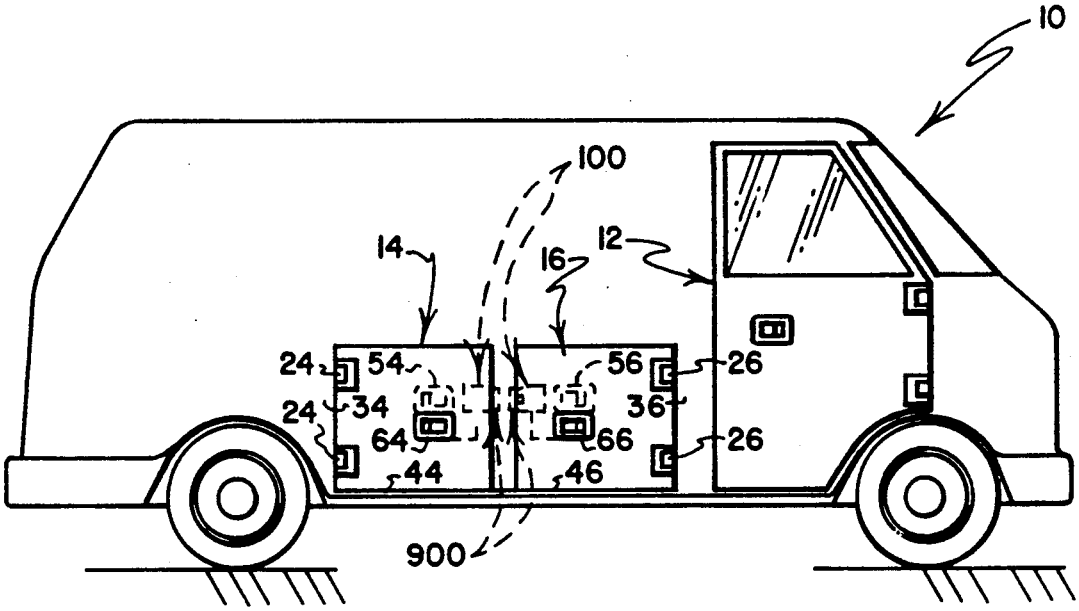
FIG. 1 is a side elevational view of a vehicle that has a pair of left and right hinged auxiliary storage compartment doors with lock assemblies that embody the preferred practice of the present invention shown in phantom to indicate locations where the lock assemblies are mounted on the doors, and with the view also showing interior and exterior handle assemblies and associated other linkage and keeper hardware.

Referring to FIG. 1, a vehicle 10 is depicted that has a passenger door 12 and a pair of auxiliary storage compartment doors 14, 16. The auxiliary storage compartment doors 14, 16 typically are of a type that are installed on specialty vehicles for purposes of permitting and preventing access to relatively small storage compartments (not shown) wherein tools, supplies and the like are carried. Lock assemblies that embody the "best mode" and "preferred practice" of the present invention are depicted in phantom in FIG. 1 as being installed on the auxiliary storage compartment doors 14, 16, and are indicated generally by the numeral 100.

In a typical application such as is depicted in FIG. 1, the auxiliary storage compartment doors 14, 16 have left and right side portions thereof that are connected by hinges 24, 26 to vehicle portions 34, 36 that surround the doors 14, 16, respectively, and that define door openings 44, 46, respectively, that are opened and closed by pivoting the hinged doors 14, 16 between "open" and "closed" positions, respectively. The lock assemblies 100 are right-mounted and left-mounted on the doors 14, 16, respectively, so as to be connected to sides of the doors 14, 16 that are opposite the door sides that are connected to the hinges 24, 26.

The door-mounted lock assemblies 100 are "slam capable," meaning that they can be "slammed" (as by closing the doors on which they are mounted) into latching engagement with suitably configured keepers that are mounted on the vehicle portions 34, 36, such as are depicted in phantom in FIG. 1 and are designated generally by the numeral 900. The doors 14, 16 are releasably retained in their "closed" positions by virtue of latching engagements that are established when the lock assemblies 100 are moved into latching engagement with the keepers 900. The doors 14, 16 are "unlatched" and enabled to be "opened" by operating interior and/or exterior handle assemblies 54, 64 and 56, 66 that typically also are mounted on the doors 14, 16, respectively.

If interior handle assemblies 54, 56 are provided, this often is done as a safeguard to assure that, if a person inadvertently becomes confined in a storage compartment that is accessible through one of the auxiliary doors 14, 16, the associated door-carried interior handle 54 or 56 can be operated by the trapped person to open the associated door 14 or 16 and thereby escape.

Figure 2:
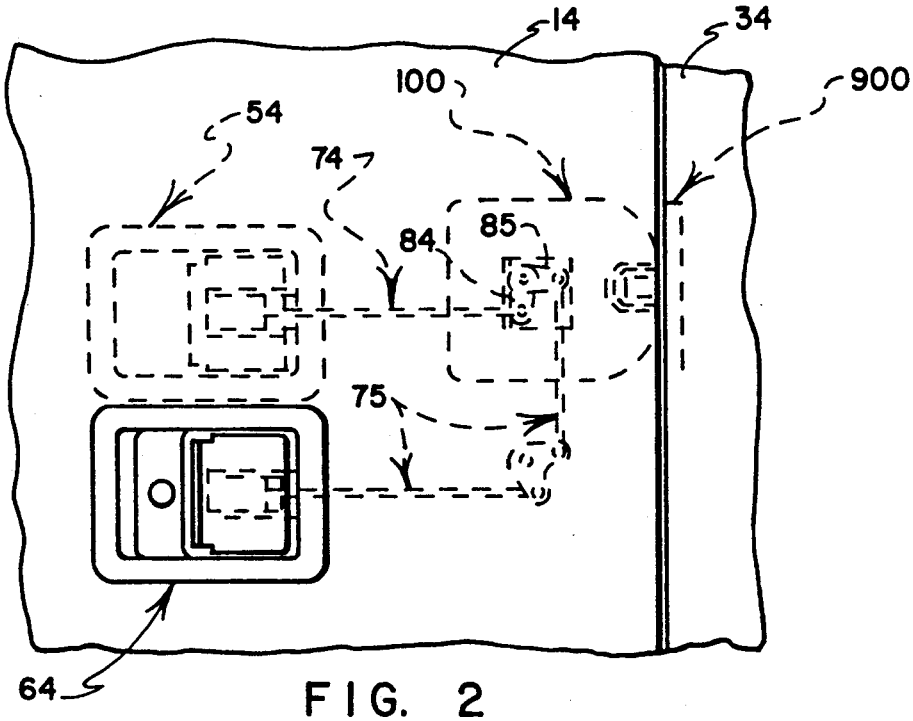
FIG. 2 is an enlarged portion of the side elevational view of FIG. 1, showing in greater detail features of one of the lock assemblies and its associated interior and exterior handle assembly and associated other linkage and keeper hardware.

Because the two lock assemblies 100 that are shown in FIG. 1 function are identical (with the exception that the mounting of each of the lock assemblies 100 and its associated hardware presents a mirror image of the mounting of the other of the lock assemblies 100 and its associated hardware), only relevant features of one of the lock assemblies 100 and its associated hardware will be described. Referring to FIG. 2, enlarged portions of the left-hinged door 14 and its adjacent door frame 34 are shown; the associated door-carried lock assembly 100 and the associated door-frame-carried keeper 900 are shown in phantom; the associated outside handle assembly 64 is depicted in solid lines; the associated inside handle assembly 54 is depicted in phantom; and linkages 74, 75 are depicted in phantom that serve to operably connect the inside and outside handle assemblies 54, 64 to the lock assembly 100. The outside handle assembly 64 is depicted as including a conventional key-cylinder 50 that can be used to selectively enable and disable the outside handle assembly 64 from operating its associated linkage 75. The handle-assembly-operated linkages 74, 75 include bell cranks 84, 85 that are positioned on opposite sides of the housing of the lock assembly 100 for connecting the linkages 74, 75 to separate "operator members" that form components of the lock assembly 100 (as will be described later herein). By this arrangement, either one of the handle-operated linkages 74, 75 may be actuated by operating its associated handle 54, 64 to operate the lock assembly 100 to effect "unlatching" of the lock assembly from latching engagement with the keeper 900 (as also will be described later herein).

As those who are skilled in the art readily will understand, a wide variety of commercially available door handle assemblies and associated linkage elements may be employed to operate the lock assemblies 100. By way of one example, reference is made to the handle assemblies and associated linkage elements that are disclosed in the aforementioned Prior Utility Patent, with particular reference being made to FIGS. 1–3 thereof and the description that is associated therewith. Because the character of operating handles and associated linkages that are used in conjunction with the lock assemblies 100 forms no part of the present invention; because features of a typical arrangement of such handles and their associated linkages are described and illustrated in the Prior Utility Patent, the disclosure of which is incorporated herein by reference; and because the character and commercial availability of such components is well known to those who are skilled in the art, further discussion of features of such handles and linkages as are depicted in FIGS. 1 and 2 need not be presented here.

Figure 3:
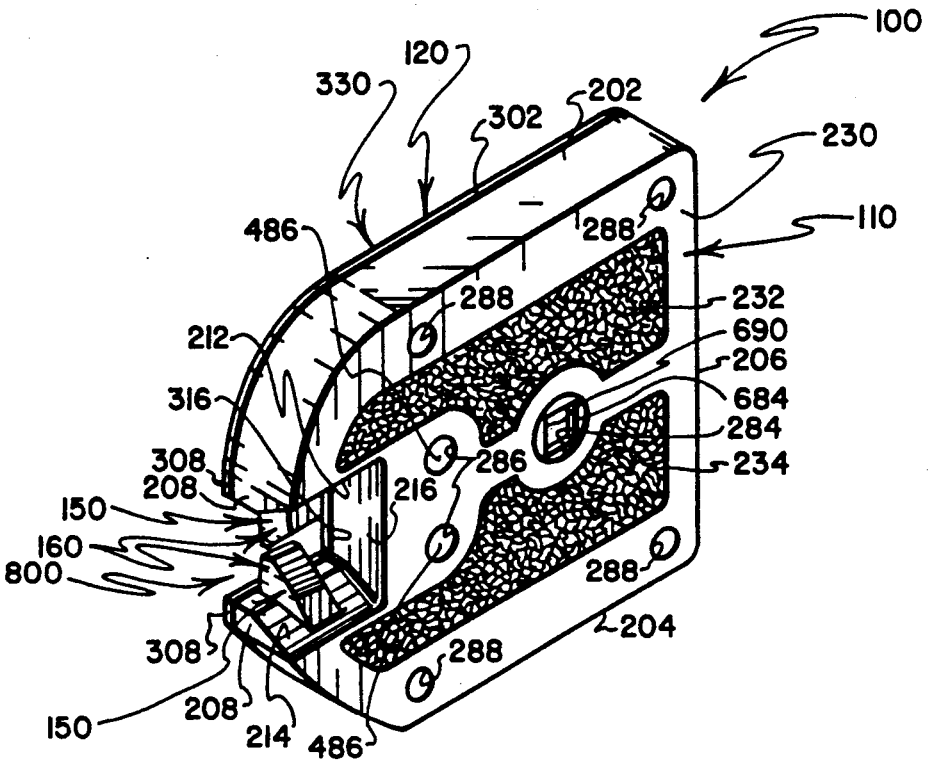
FIG. 3 is a perspective view, on an enlarged scale, showing a lock assembly that embodies the "best mode" and the "preferred practice" of the present invention, with the view showing principally exterior surface features of a first of two housing members that protectively enclose and movably mount operating components of the lock assembly, and with the view showing a pair of opposed latch members extending into opposite side regions of a keeper-receiving passage that is defined by the housing members.
Figure 4:
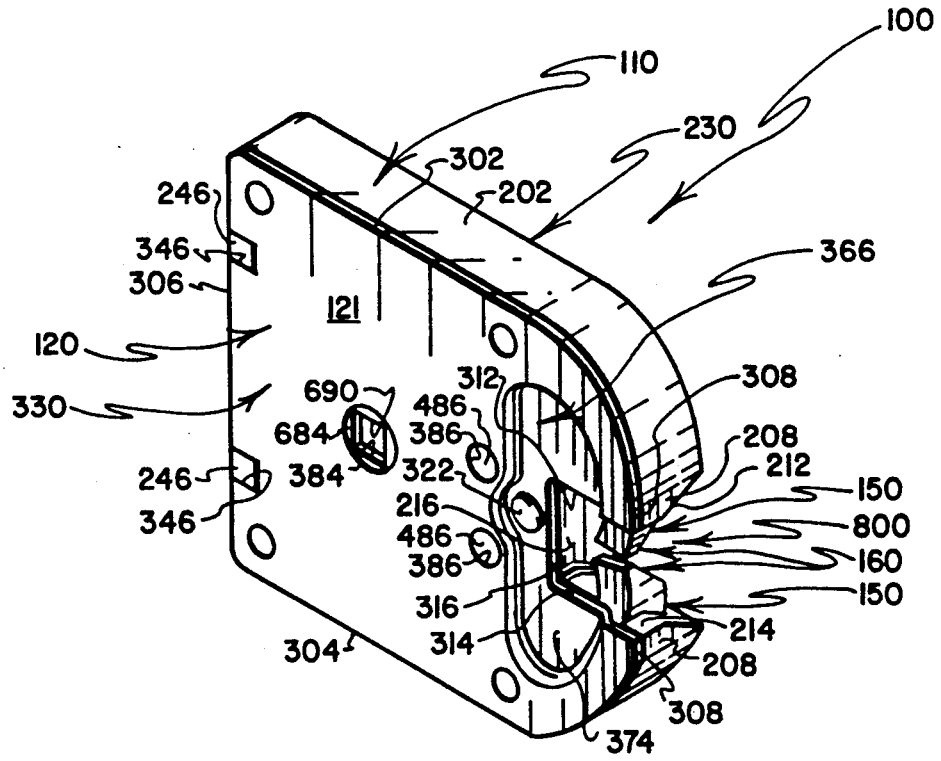
FIG. 4 is a perspective view similar to FIG. 3 but showing principally exterior surface features of a second of the two housing members.
Figure 5:
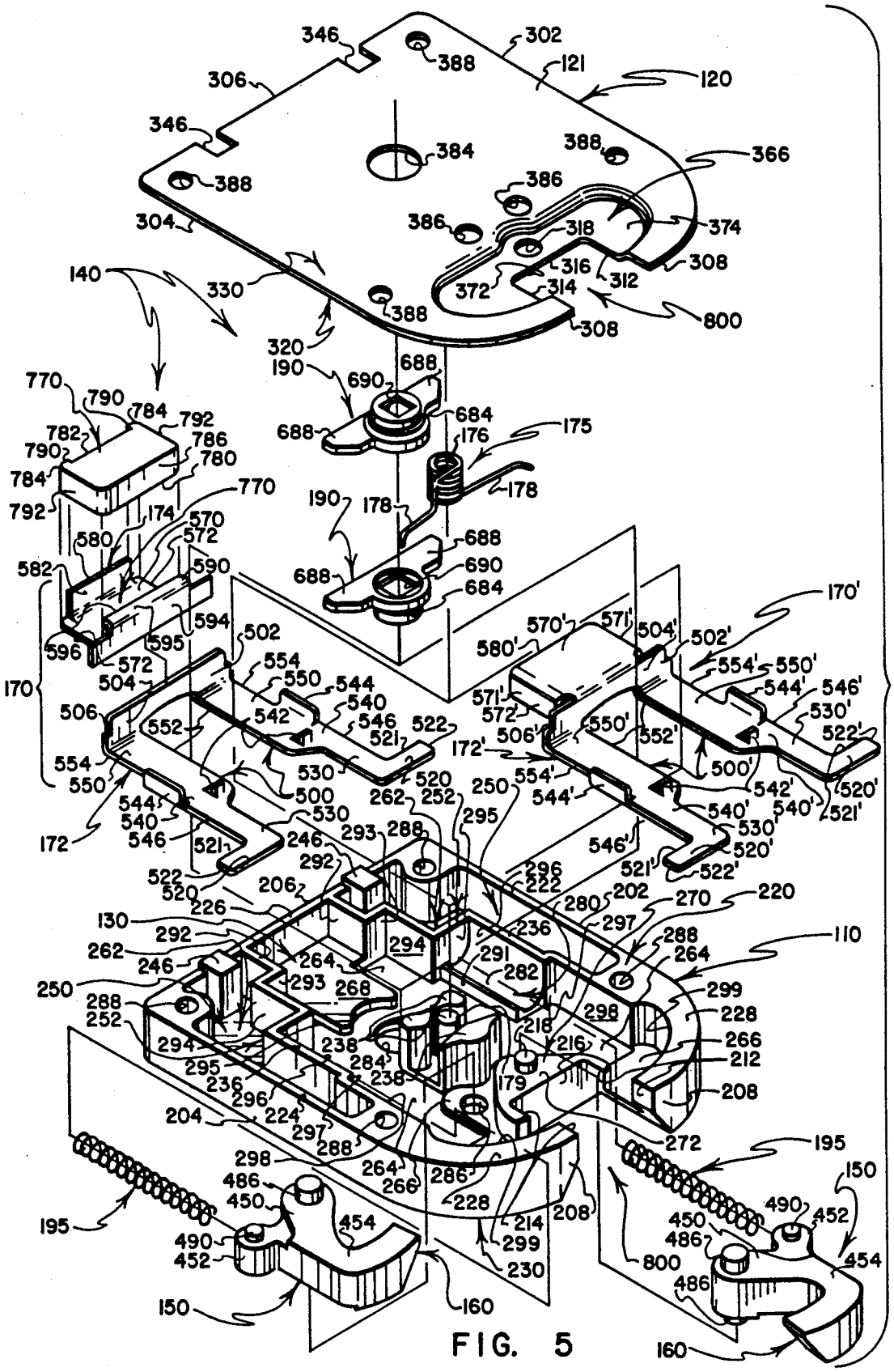
FIG. 5 is an exploded perspective view showing components of the lock assembly, with the view showing alternate "first" and "second" embodiments of generally U-shaped slides that may be substituted interchangeably for use with the other depicted components, with the "first" slide embodiment being a plural-piece assembly, and with the "second" slide embodiment being of one-piece design.

Turning now to an overview of the lock assembly 100, and referring to FIGS. 3–5, a housing assembly is provided by a first housing member 110 and a second housing member 120 that are configured to extend in congruent overlying engagement. Referring to FIG. 5, the first and second housing members 110, 120 cooperate to define a central chamber 130 that receives, operably positions and movably mounts a number of operating components that are indicated generally by the numeral 140. Defined near a curved end region of the housing assembly is a generally U-shaped keeper-receiving passage that is indicated generally by the numeral 800. Included among the operating components 140 are a pair of oppositely pivoted latch members 150. The latch members 150 have tapered, distal end regions 160 that extend through latch member passages 700 that open into the keeper-receiving passage 800 on opposite sides thereof. The tapered distal end regions 160 of the latch members 160 move in opposite directions so as to be capable of retracting into the latch member passages 700 to release their engagement with a suitably configured keeper 900 (shown in phantom in FIGS. 1 and 2, and more clearly in FIGS. 12 and 13), or to project into opposite sides of the keeper-receiving passage 800 so as to selectively grip portions of a suitably configured keeper. Moreover, and as will be explained later herein in greater detail, the latch members 150 can be "slammed" into latching engagement with a suitably configured keeper 900 as by moving a door (such as one of the doors 14, 16) on which the lock assembly 100 is mounted to its "closed" position.

Figure 6:
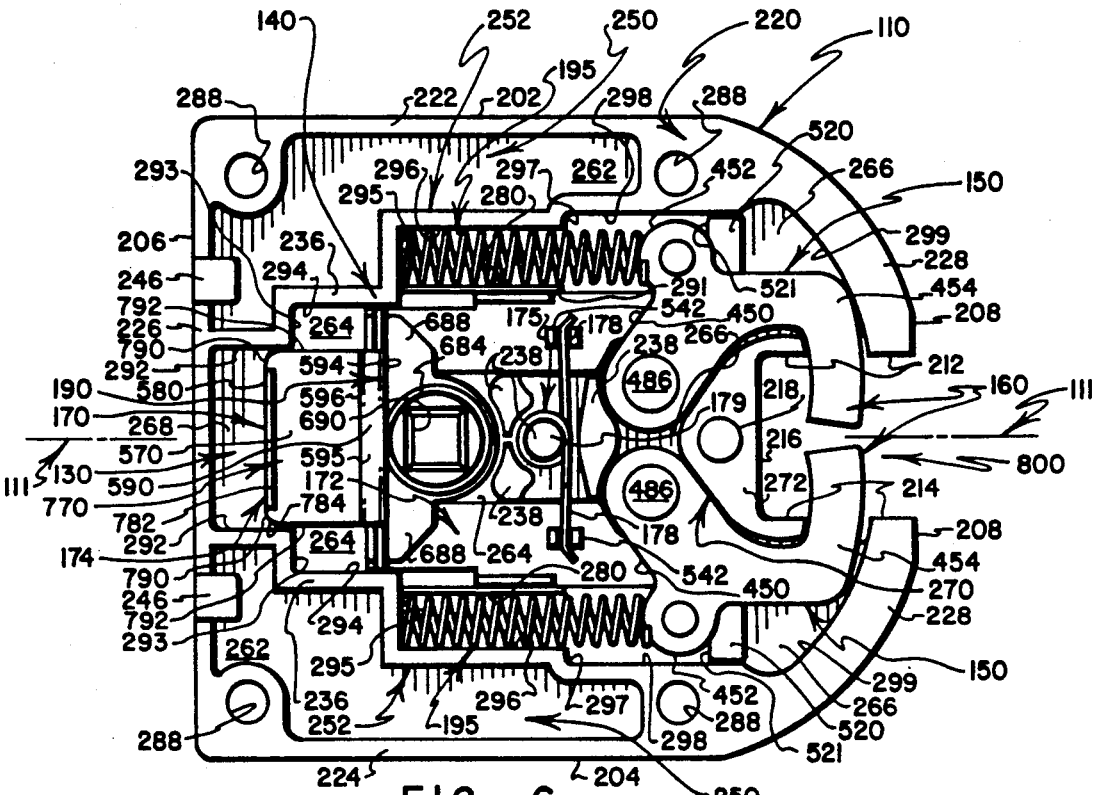
FIG. 6 is a side elevational view of interior features of a first of the two housing members, with the view also showing others of the lock assembly components installed within a central chamber that is defined by the first housing member, with the installed components including the plural-piece "first" slide embodiment (component parts of which are best seen in FIG. 5), and with the installed components being positioned as they normally are when the lock assembly is ready to be "slammed" into latching engagement with a suitably configured keeper.
Figure 14:
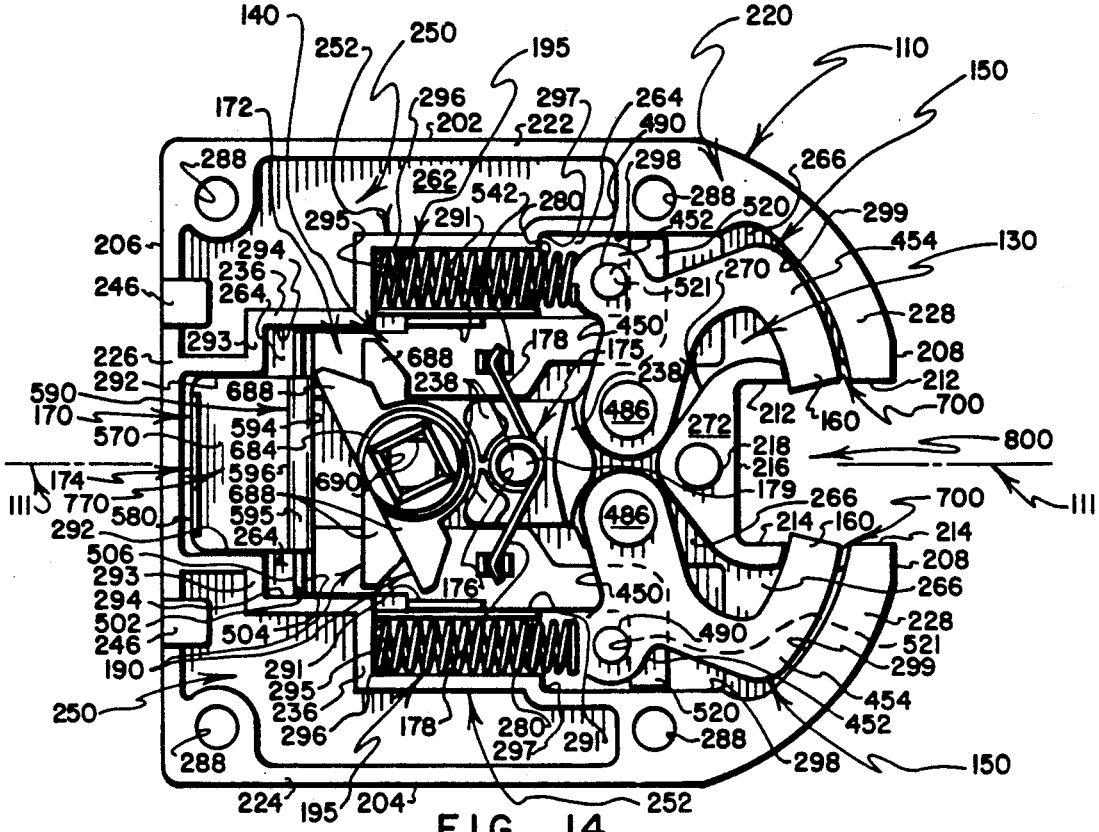
FIG. 14 is a side elevational view similar to FIG. 6 but showing selected operating components moved to effect "unlatching" of the latch members of the subject lock assembly.

Referring to FIGS. 5 and 6, also included among the operating components 140 is a selected one of two types of slide embodiments 170, 170', a dual-acting torsion coil spring 175 for biasing the selected one of the slides 170, 170' toward its "latching" position (shown in FIG. 6), a pair of pivotally movable slide operators 190 (only one of which is viewable in FIG. 6, but portions of both of which are viewable in FIGS. 5 and 14) that are independently pivotal such that either one can effect movement of the selected slide 170, 170' toward its "unlatching" position (as is depicted in FIG. 14), and a pair of compression coil springs 195 that bias the latch members 150 toward their "latched" positions (shown in FIGS. 3, 4 and 6).

Turning now to a more detailed description of features of the lock assembly 100, the first and second housing members 110, 120 each are relatively flat and are bounded by correspondingly configured side and end surfaces so as to permit their being positioned in overlying relationship such that their corresponding side and end surfaces extend substantially congruently. The first housing member 110 preferably is formed using conventional die casting techniques of manufacture to provide a relatively thick and rigid metal component having a hollow interior that is configured to contribute significantly to the mounting and positioning of the aforementioned operating components 140—and that cooperates with the second housing member 120 to protectively enclose, position and mount the operating components 140. The second housing member 120 preferably is formed using metal stamping techniques to cut and compressively form the second housing member 120 from sheet metal.

Figure 7:
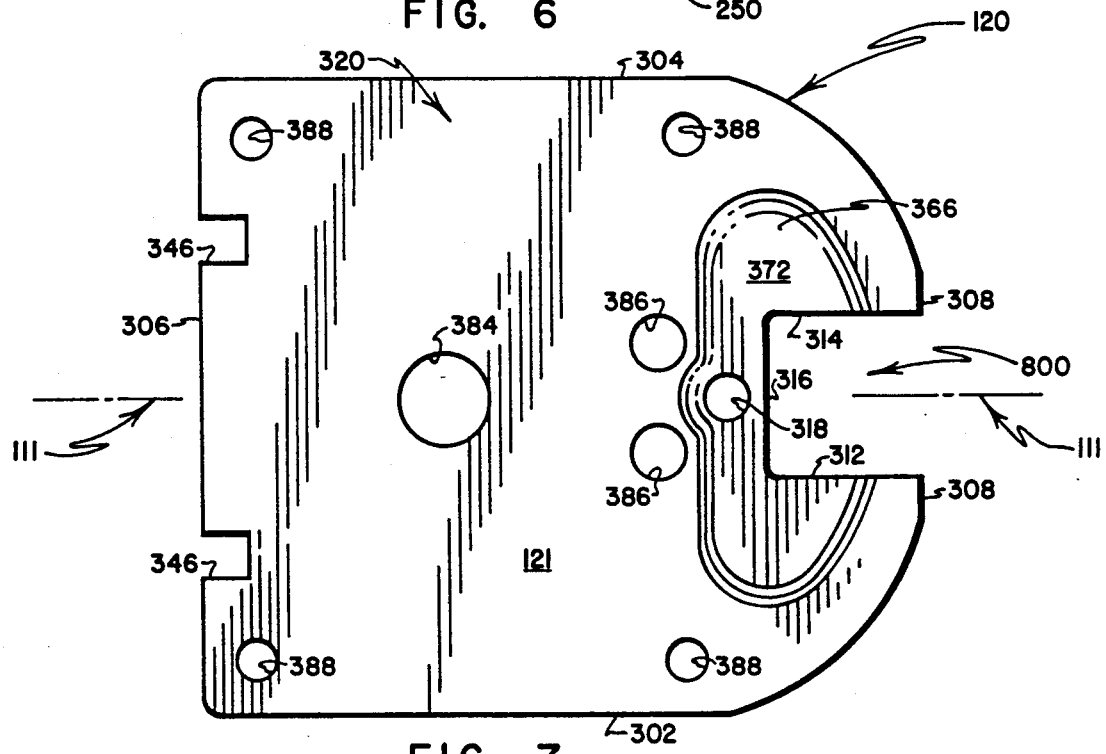
FIG. 7 is a side elevational view of interior surface features of the second of the two housing members.
Figure 8:
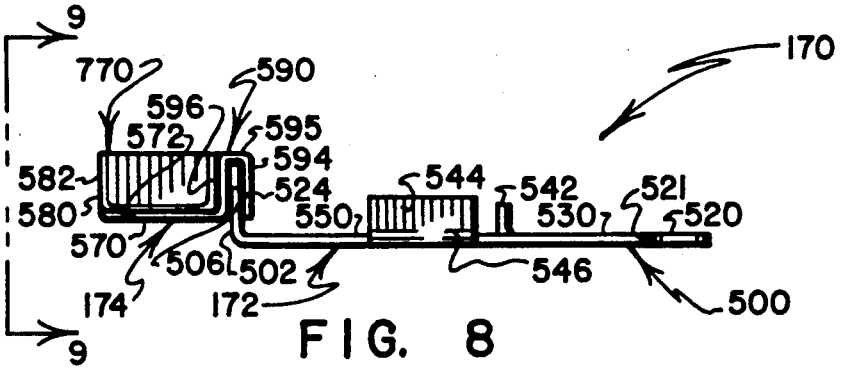
FIG. 8 is a side elevational view of a plural-piece assembly that forms the "first" of the two slide embodiments that are depicted in the exploded view of FIG. 5.
Figure 9:
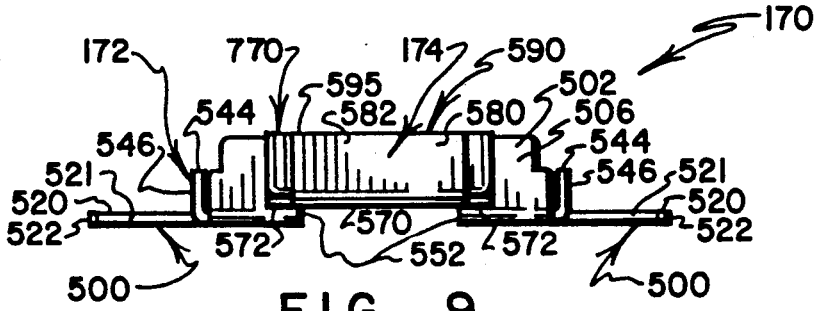
FIG. 9 is a left end elevational view thereof as seen from a plane indicated by line 9—9 in FIG. 8.

Referring variously to FIGS. 3–7, the first and second housing members 110, 120 have opposed side sur faces that are designated generally by the numerals 202, 204 and 302, 304, respectively; have opposed end surfaces that are designated generally by the numerals 206, 208 and 306, 308, respectively; and have passage-defining surfaces 212, 214, 216 and 312, 314, 316 that define the generally U-shaped keeper-receiving passage 800 that opens through the end surfaces 208, 308, respectively. Referring to FIGS. 5–7, the housing members 110, 120 have interior surfaces 220, 320, respectively, that face toward each other. Referring to FIGS. 3–5, the housing members 110, 120 have exterior surfaces 230, 330, respectively, that face away from each other—and that define opposed exterior surfaces of the lock assembly 100. The side sur faces 202, 204, together with the end surfaces 206, 208 and the passage-defining surfaces 212, 214, 216 define the periphery of the first housing member 110 and define the peripheries of the interior and exterior surfaces 220, 230. The side surfaces 302, 304, together with the end surfaces 306, 308 and the passage-defining surfaces 312, 314, 316 define the periphery of the second housing member 120 and define the peripheries of the interior and exterior surfaces 320, 330.

Referring to FIG. 3, the exterior surface 230 of the first housing member 110 is substantially flat—except that, in preferred practice, a pair of surface areas 232, 234 are provided with a textured finish to enhance the appearance of the first housing member 230 and to give major exterior portions of the lock assembly 100 substantially the same appearance that forms the subject of U.S. Trademark Reg. Pat. No. 1,455,909. In view of the substantially flat nature of the exterior face 230, it can be said that the face 230 is comprised of surface elements that extend substantially in a first imaginary plane (not shown).

Referring to FIGS. 5, 6, 14 and 15, the interior surface 220 of the first housing member 110 is comprised of peripherally extending surface portions 222, 224, 226, 228; inwardly located surface portions 236 that define edge surfaces of divider walls 252; and centrally located surface portions 238 that define ends of projecting formations 260, 262 and 264. The surface portions 222, 224, 226, 228, 236 and 238 comprise the interior surface 220 and all extend substantially in a common second imaginary plane (not shown). The exterior and interior surfaces 230, 220 are oriented such that the aforementioned first and second imaginary planes extend substantially parallel, with the distance therebetween defining what will be referred to as a "major thickness" of the first housing member 110.

While significant portions of the first housing member 110 have a thickness that corresponds to the aforementioned "major thickness," three portions of the first housing member 110 are formed (during casting of the first housing member 110) so as to be of greater thickness, namely a generally cylindrical post-like projection 218 that is provided at a location near the passage surface 216, and a pair of generally rectangular projections 246 that are located along spaced portions of the end surface 206.

During the process of assembling the components of the lock assembly 100, the rectangular projections 246 are inserted into U-shaped notches 346 that are formed at spaced locations along the end surface 306 of the second housing member 120; and, an end portion of the post-like projection 218 extends through an aligned hole 318 that is formed through the second housing member 120 and then is "staked" so as to provide a head-like formation 322 (shown in FIG. 4) that overlies portions of the exterior surface 330 of the second housing member 120 to permanently clamp into secure mating engagement the interior faces 220, 320 of the first and second housing members 110, 120, respectively. When the post-like projection 218 is staked so as to provide the head-like formation 322, the height of the post-like projection is diminished so as to ultimately provide a thickness that is less than the aforedescribed "major thickness."

Figure 15:
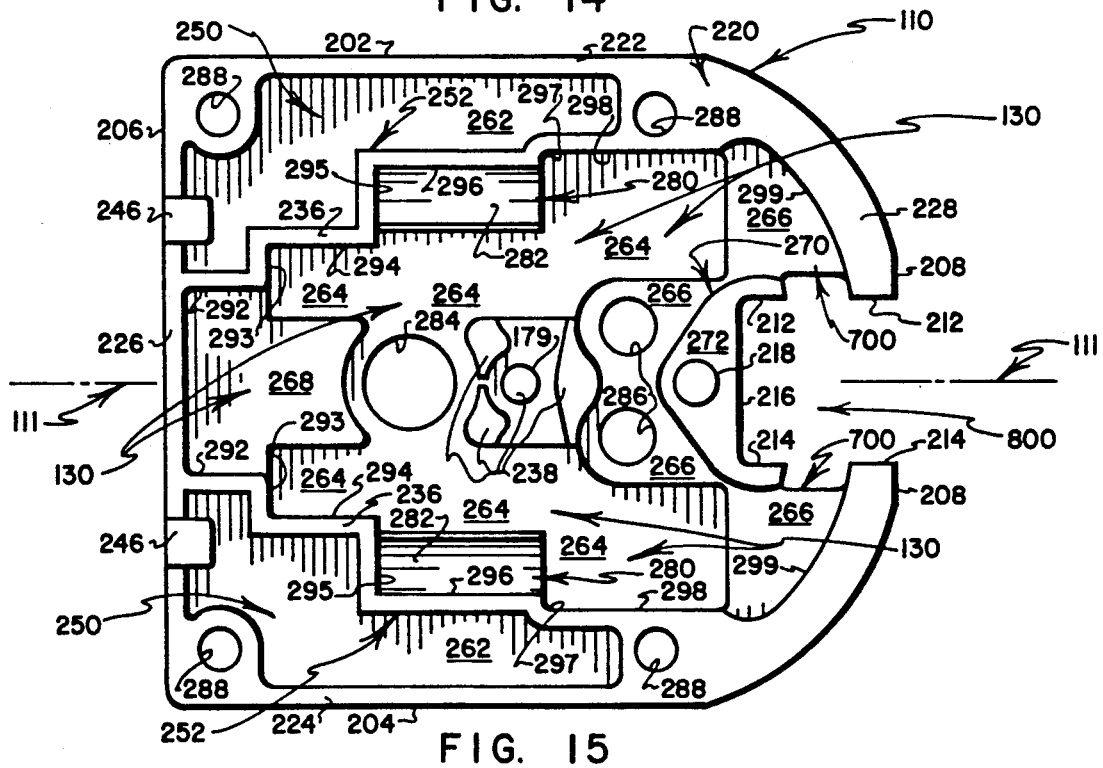
FIG. 15 is a side elevational view similar to FIGS. 6 and 14 but with all operating components removed from the central chamber of the first housing member so that underlying interior features thereof can be seen.

While the thickness of the first housing member 110 exceeds the aforedescribed "major thickness" only at the aforedescribed locations, there are a number of locations wherein the first housing member 110 has thicknesses that are significantly less than the major thickness. Referring principally to FIGS. 5 and 15, the major thickness of the first housing member is "relieved" such that a pair of irregularly shaped "side chambers" 250 extend along opposite side portions of the aforementioned relatively larger "central chamber" 130. The divider walls 252 (atop which the surface portions 236 are formed) separate the side chambers 250 from the central chamber 130. While the side chambers 230 have relatively flat "floor" surfaces 262 that give the first housing member 110 relatively uniform, relatively thin bottom walls that underlie the side chambers 250, in contrast, the central chamber 130 has a plurality of "floor levels," defined at various locations, as will now be described.

Referring to FIG. 15, a "primary" floor level is defined by something of an H-shaped central floor portion 264—and, the central portion 264 cooperates with the exterior surface 230 to give the first housing member 110 its minimum thickness. A "secondary" floor level is defined by floor portions 266 that are located within the general vicinity of an upstanding U-shaped formation 270 that defines portions of the passage walls 212, 214, 216. The floor portions 266 cooperate with the exterior surface 230 to define a floor thickness that is slightly greater than the minimum thickness that is provided by the central floor portion 264.

A "tertiary" floor level is defined by a floor portion 268 that extends into the central chamber 130 from the end wall 206 so as to provide a region of still greater floor thickness. Opposite sides of the tertiary floor portion 268 are bounded by parallel side walls 269 that extend substantially perpendicular to the plane of the end wall 206 of the first housing member 110.

A pair of curved-bottom channels 280 extend along portions of the divider walls 252; have bottom portions 282 that cooperate with the exterior surface 230 to provide a thickness that is slightly greater than the thickness that is provided by the tertiary floor portions 268; and are bordered along their inner sides by upstanding wall portions 291 that extend parallel to each other at locations on opposite sides of the central floor portion 264 for purposes of engaging and assisting in guiding sliding movements of whichever one of the slide embodiments 170, 170' that is selected to be used within the central chamber 130.

Defining still another floor level is the end surface 272 of the upstanding U-shaped formation 270. The end surface 272 defines a thickness that is less than the aforesaid "major thickness," but is nonetheless located only a short distance spaced inwardly from the aforesaid second plane of the interior surface 220. As will be noted from viewing FIGS. 5, 6, 14 and 15, the post-like formation 218 extends perpendicularly away from the plane of the end surface 272.

Many of the aforementioned and other features of the first and second housing members 110, 120 are configured so as to give the first and second housing members 110 shapes that are substantially symmetrical about a common imaginary central plane 111, the position of which is indicated by center line segments that appear in FIGS. 6, 7, 14 and 15. While a number of these symmetrical features are mentioned in the paragraphs that follow, there are many additional features of components of the lock assembly 100 that are not emphasized in the text hereof but which nonetheless are arranged symmetrically about the center plane 111, as will be readily apparent to those who are skilled in the art from reviewing what is depicted in the accompanying drawings.

A plurality of holes are formed through the first housing member 110, all of which extend along spaced parallel axes (not shown) that intersect the aforesaid imaginary first and second planes so as to extend substantially perpendicular thereto. A relatively large diameter hole 284 opens through the primary floor 264 into a central part of the central chamber 130, with the axis of the hole 284 being oriented so as to extend within the central plane 111. A cylindrical hub portion 684 of one of the lock operator members 190 extends into and is journaled by the hole 284 for smooth rotation about the axis of the hole 284, as will be explained in greater detail.

A pair of relatively medium sized holes 286 open through the secondary floor portions 266, with the axes of the holes 286 being located on opposite sides of the central plane 111 and at substantially equal distances there from. Cylindrical formations 486 that are formed on the latch members 150 extend into and are journaled by the holes 286 for smooth rotation about the axes of the holes 286, as will be explained in greater detail.

Four relatively small diameter mounting holes 288 open through major thickness peripheral portions of the first housing member 110, with the holes 288 being arranged in spaced pairs, and with the holes 288 of each such pair having axes that are located on opposite sides of and at substantially equal distances from the central plane 111. Elongate, threaded fasteners (not shown) extend through the holes 288 for purposes of securely mounting the lock assemblies 100 on closures such as the aforedescribed auxiliary doors 14, 16.

Referring to FIGS. 5, 6, 14 and 15, the divider walls 252 that segregate the side chambers 250 from the central chamber 130 have pairs of wall formations that are located at equal distances from the central plane 111 so as to give the divider walls 252 configurations that are symmetrical about the center plane 111. Among these formations are wall portions 292, 294, 296 and 298 that extend parallel to the central plane 111 and are located at progressively greater distances from the center plane 111. Transversely extending wall portions 293 connect the wall portions 292, 294. Transversely extending wall portions 295 connect the wall portions 294, 296 and define ends of the curved-bottom channels 280.

Curved wall formations 297 connect the wall portions 296, 298. Curved, inwardly-facing wall surfaces 299 join with the wall portions 298 to protectively enclose regions wherein hook-shaped portions of the latch members 150 pivotally move in opposed directions during latching and unlatching movements of the tapered distal end regions 160 of the latch members 150. Portions of the latch member passages 700 that open into the keeper-receiving passage 800 are defined by the curved wall surfaces 299.

The parallel extending wall surfaces 291, 292 and 298 extend alongside portions of the chamber 130 wherein sliding movements are executed by one or the other of the slide member embodiments 170, 170' that has been installed in the central chamber 130 for enabling the latch members 150 to be pivoted to their unlatching positions (as depicted in FIG. 14) in response to pivoting of one or the other of the lock operator members 190 (as also is depicted in FIG. 14).

Referring to FIGS. 4, 5 and 7, the second housing member 120 is formed as a stamping from sheet metal, and has main body portions 121 that are substantially planar. The main body portions 121 extend peripherally about portions of a C-shaped depressed or indented portion 366 that defines a relatively flat C-shaped inwardly-facing surface portion 372 (see FIG. 7). The surface portion 372 extends in a plane that substantially parallels the plane of the main body portions 121. The surface portion 372 overlies and extends into engagement with the top surface 272 of the U-shaped formation 270 of the first housing member 110.

The hole 318 that receives the post-like projection 218 of the first housing member 110 is formed through the C-shaped indentation 366. The head-like formation 322 (see FIG. 4) that is formed by staking the end of the post-like projection 218 serves to clampingly engage exterior surface portions 374 of the C-shaped indentation 366.

An array of holes 384, 386, 388 (that are symmetrical about the center plane 111 in precisely the same manner as has been described in conjunction with the positioning and orientation of corresponding ones of the holes 284, 286, 288) is formed through the second housing member 120. The holes 384, 386, 388 that are formed through the second housing member 120 are precisely aligned with the holes 284, 286, 288 that are formed through the first housing member 110. Likewise, the diameters of the holes 384, 386, 388 correspond precisely with the relatively large, medium and small diameters of the holes 294, 286, 288, respectively.

Referring to FIGS. 5, 6 and 14, the latch members 150 have configurations that are left and right mirror images of each other, with the configurations of each of the latch members 150 bearing a general resemblance to the configuration of the numeral "2." Cylindrical projections 486 extend from opposite sides of one end region 448 of an elongate base portion 450 of each of the latch members 150. The cylindrical projections 486 extend into and are journaled by the holes 286, 386 to mount the latch members 150 for smooth pivotal movement relative to the housing members 110, 120. Opposite end regions 452 of the base portions 450 have additional cylindrical projections 490 extending from opposite sides thereof. The additional projections 490 slide along interior surface portions of the housing members 110, 120, and do not in any way limit or inhibit latching or unlatching pivotal movements of the latch members 150 about the axes of the projections 486.

Two significant functions are provided by such ones of the cylindrical projections 490 as extend toward the primary floor surface 464 of the first housing member. As is best seen in FIG. 5, oppositely projecting foot portions 520, 520' are provided on the slide embodiments 170, 170', and leftwardly-facing edge surfaces 521, 521' are defined by the foot portions 520, 520'. Depending on which one of the slide embodiments 170, 170' that is selected for incorporation into the lock assembly 100, either the edge surfaces 521 or the edge surfaces 521' are positioned to abuttingly engage such ones of the cylindrical projections 490 as extend toward the primary floor surface 464. Referring to the phantom-line depictions of the edge surfaces 521 that are shown in FIG. 14, it will be seen that, when the slide embodiment 170 is moved leftwardly within the central chamber 130 (which occurs as the result of pivotal operation of one of the operators 190, as will be explained later herein), the edge surfaces 521 abuttingly engage adjacent ones of the cylindrical projections 490 and cause corresponding pivotal unlatching movements of the latch members 150. Thus, one function that is served by such ones of the cylindrical projections 490 as extend toward the primary floor surface 264 is to provide an abutting-type of driving connection between the latch members 150 and whichever one of the slide embodiments 170, 170' that may be selected for use in the lock assembly 100.

Figure 12:
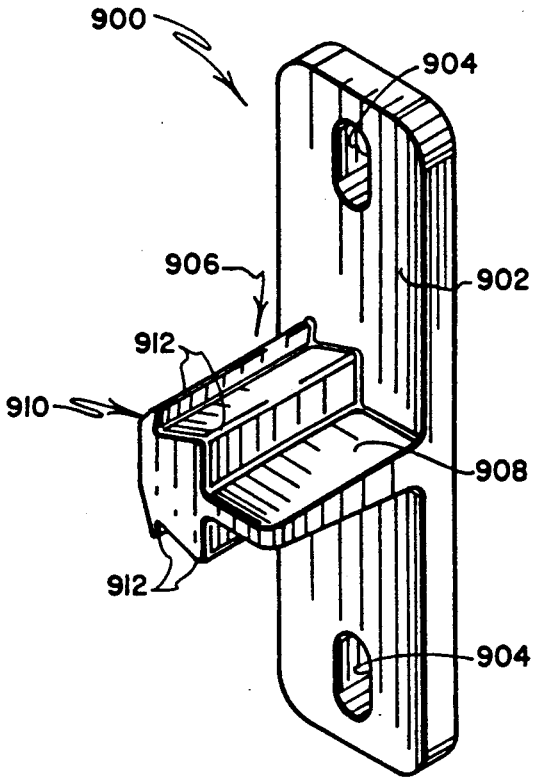
FIG. 12 is a perspective view of a suitably configured keeper for use with the subject lock assembly.
Figure 13:
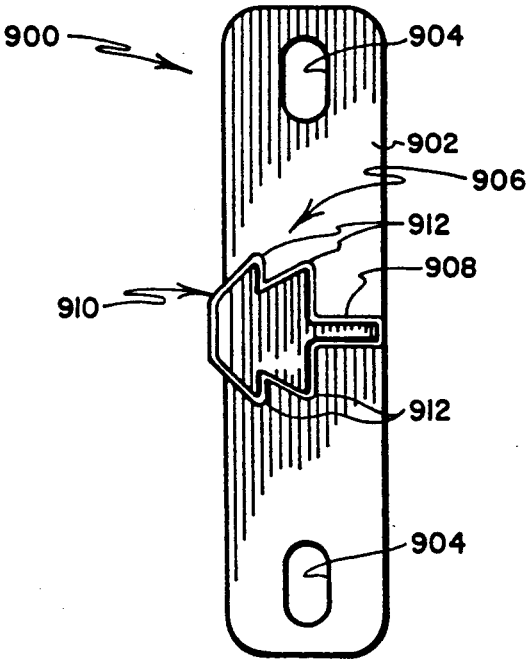
FIG. 13 is a side elevational view thereof.

A second function that is provided by the abutting type driving connection that is established between the latch members 150 and a selected one of the slide embodiments 170, 170' is that, while the operation of the compression coil springs 195 tends to bias the latch members 150 toward a position wherein the described ones of the cylindrical projections 490 engage the slide edge surfaces 521, 521', the latch members 150 nonetheless remain free to move independently relative to the selected slide embodiment 170, 170'. Stated in another way, the aforedescribed driving engagement between selected ones of the projections 490 and the slide edge surfaces 521, 521' is not necessarily maintained at all times—whereby the lock assembly 100 is given its "slam capability" (i.e., its ability to be "slammed" toward a suitably configured keeper 900 so that, as portions of the keeper 900 are engaged by the tapered distal end regions 160 of the latch members 150, the latch members 150 may pivot in opposition to the actions of their biasing springs 195 (and without causing any corresponding movement of or application of force to the selected slide embodiment 170, 170') to ride over frontal portions of a suitably configured keeper 900 so as to drop into latched position behind such frontal portions (as will be explained in greater detail later herein in conjunction with a discussion of the preferred form of keeper 900 that is depicted in FIGS. 12 and 13).

Returning now to a discussion of the configuration of the latch members 150, and referring to FIGS. 5, 6 and 14, curved, hook-shaped portions 454 project away from the base portions 450 of the latch members 150. The tapered, distal end regions 160 of the latch members 150 are defined by the hook-shaped portions 454, and extensible through the opposed latch member passages 700 into opposite sides of the U-shaped keeper-receiving passage 800.

The compression coil springs 195 have central portions thereof that extend along the curved-bottom channels 280 of the first housing member 110. One end of each of the springs 195 engages a separate one of the housing wall surfaces 295. The other end of each of the springs 195 engages the base portion 452 of a separate one of the latch members 150.

Referring to FIG. 5, the plural-piece slide embodiment 170 includes three component parts, namely two snap-together sheet metal stampings 172, 174 and a third part that preferably takes the form of a block of plastic material 770 that is configured to be snugly received within what will be referred to as a "pocket 772" that is defined by wall portions of the stamping 174. Before turning to a description of the block 770 and the manner in which it is "pocket mounted" by the stamping 174, features of the stampings 172, 174 will be described.

In FIG. 5 the stampings 172, 174 are shown "disassembled" one from the other (i.e., prior to being "assembled"). This is in contrast to the "assembled" relationship of the stampings 172, 174 that is depicted in FIGS. 6, 8, 9, 14 and 16. Referring principally to FIG. 5, the stamping 172 is the larger of the two stampings 172, 174 and is formed from sheet metal that is relatively thicker than is the sheet metal from which the relatively smaller stamping 174 is formed.

Figure 10:
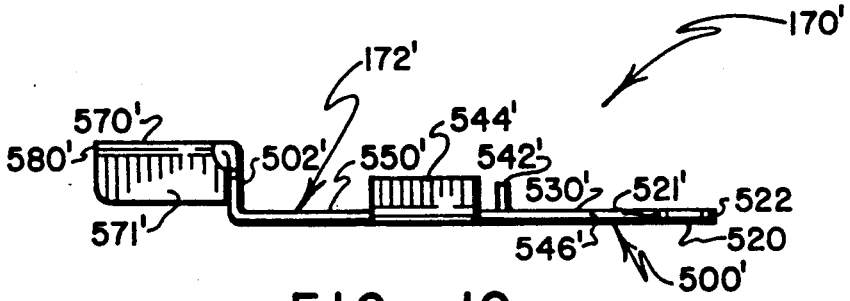
FIG. 10 is a side elevational view that is similar to FIG. 8 but that depicts the one-piece "second" slide embodiment that also is shown in FIG. 5, and that can be used interchangeably with the plural-piece "first" slide embodiment of FIGS. 8 and 9.
Figure 11:
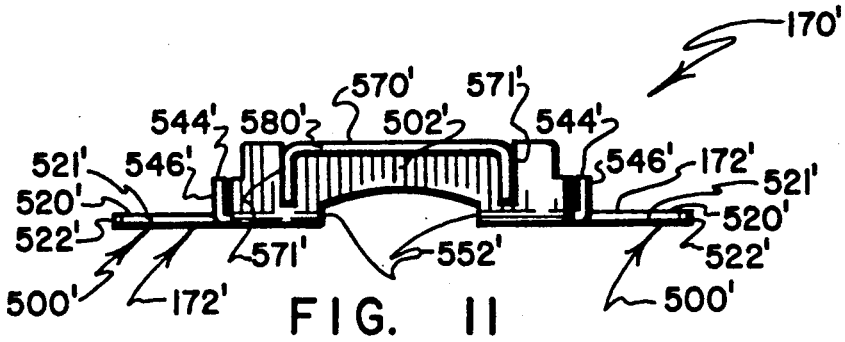
FIG. 11 is a left end elevational view thereof.

There are a substantial number of similarities between the assembled combination of the stampings 172, 174 (as shown in FIGS. 6, 8, 9, 14 and 16) and the one-piece stamping 172' (as shown in FIGS. 5, 10 and 11) that comprises the slide embodiment 170'. By way of example, in the plural-piece embodiment 170, the larger of the two stampings 172 has a pair of spaced, elongate, substantially parallel-extending portions that are indicated generally by the numeral 500; and, the spaced portions 500 are joined near one end region by a bridging leg formation or "central region" 502. In a similar fashion, the one-piece slide embodiment 170' consists of a single stamped metal member 172' that has a pair of elongate, substantially parallel extending portions that are indicated generally by the numeral 500'; and, the spaced portions 500' are joined near one end region by a bridging leg formation or "central region" 502'.

The parallel extending portions 500, 500' of the members 172, 172' are identical one with another. Moreover, each of the pairs of portions 500 or 500' that are connected by an associated one of the bridging formations 502 or 502' are configured so as to present left and right mirror images of each other. Thus, while features of the portions 500' are depicted in FIGS. 10 and 11, it will be understood that, since the paired portions 500, 500' are completely identical in form, features of the pair of portions 500 (that are shown in FIGS. 5, 6, 8, 9, 14 and 16) are duplicated in the pair of portions 500' (that are shown in FIGS. 5, 10 and 11).

Referring principally to FIG. 5 (but also from time to time to FIGS. 6, 8, 9, 14 and 16), the portions 500 define a number of formations that are arranged symmetrically about the center plane 111 (an imaginary plane that is indicated by center line segments that appear in FIGS. 5, 6, 7 and 14–17) including: transversely extending foot portions 520 that have distal outer end surfaces 522 that are configured to slide along the interior housing surfaces 298 during movement of the slide member 170 between its latching position (shown in FIG. 6) and its unlatching position (shown in FIG. 14); lower leg portions 530 that are of relatively uniform width until they reach what will be referred to as "knee" regions 540 where a pair of relatively small tab portions 542 and a pair of relatively large tab portions 544 are turned upwardly (from a plane, not shown, within which a majority of the material extends that forms the members 500), with the lower leg portions 530 and the upwardly-turned tab portions 544 cooperating to define outer surfaces 546 that are configured to slide along the interior housing surfaces 291 during latching and unlatching movements of the slide member 170; and, upper leg portions 550 that are relatively wider than the lower leg portions 530 and have inner and outer surfaces 552, 554 that are configured to engage the interior housing surfaces 269, 294, respectively, during latching and unlatching movements of the slide member 170.

The bridging leg formation or "central region" 502 comprises an upwardly turned, integrally formed extension of the upper leg portions 550, and is configured to bridge the tertiary floor portion 568 during latching and unlatching movements of the slide member 170. The bridging leg formation or "central region" 502 has opposed side surfaces 504, 506.

The member 172' that forms the one-piece slide embodiment 170' has features that correspond to features of the member 172 that have just been described. Identical reference numerals are used in the drawings to designate identical features of the slide components 172, 172' except that the numerals used with the slide component 172' carry a "prime" mark.

Referring principally to FIG. 5 (but with occasional reference also to FIGS. 6, 8, 9, 14 and 16), the smaller component 174 of the plural-piece slide embodiment 170 has a generally flat central portion 570 that extends from the vicinity of the bridging leg or "central region" 502 toward the end wall 206 of the first housing member 110. Opposed side surfaces of the flat central portion 570 are indicated by the numerals 572. The opposed side surfaces 572 are configured to slide along the interior housing surfaces 292 during latching and unlatching movements of the plural-piece slide embodiment 170. In a similar fashion, the one-piece slide embodiment 170' has a generally flat central portion 570' that extends toward the housing end wall 206 and has downwardly-turned flanges 571' that define opposed side surfaces 572' that are configured to slide along the interior housing surfaces 292 during latching and unlatching movements of the one-piece slide embodiment 170'. While the central portion 570' of the one-piece slide embodiment 170' is formed as an integral extension of the associated bridging leg 502', in the plural-piece slide embodiment 170 the central portion 570 is defined by the separate, smaller component 174.

The smaller component 174 of the plural-piece slide embodiment 170 has still another feature in common with the integrally formed one-piece slide embodiment 170', namely end surfaces 580, 580' that are provided along the left ends of the central portions 570, 570'. The end surfaces 580, 580' are configured to abut the end wall 206 of the first housing member 110 and to thereby serve as "stops" to limit the "unlatching" movement that is executed by the slide embodiments 170, 170' in response to operation of one or the other of the operator members 190 (the operation of which will be described shortly). In the plural-piece embodiment 170, an upwardly-turned flange 582 assists in defining the end surface 580. In the one-piece embodiment 170', the downwardly turned flanges 571' assist in defining the end surface 580'.

The smaller stamped component 174 of the plural piece slide embodiment 170 has a U-shaped clip-like mounting portion 590 that has no corresponding formation in the structure of the one-piece slide embodiment 170'. The U-shaped clip 590 consists of two substantially parallel wall portions 594, 596 that are interconnected by an integrally formed connecting wall portion 595. The connecting wall portion 595 holds the wall portions 594, 596 in closely spaced relationship with just enough room there between to permit the bridging leg formation or "central region" 502 of the larger stamped component 172 to be inserted therebetween. The wall portions 594, 595 and 596 are configured assure that, when the bridging leg formation or "central region" 502 is inserted between the wall portions 594, 596, the parallel wall portions 594, 596 extend along and securely clampingly grip the opposed surfaces 504, 506, respectively, of the bridging leg or "central region" 502. The clamp-like gripping of the bridging leg or "central region" 502 of the large stamping 172 by the parallel walls 594, 596 of the small stamping 174 serves both to couple the small stamping 174 to the large stamping 172 in substantially a "snap-together" fashion, and to structurally reinforce and rigidify the bridging leg or "central region" 502.

Figure 16:
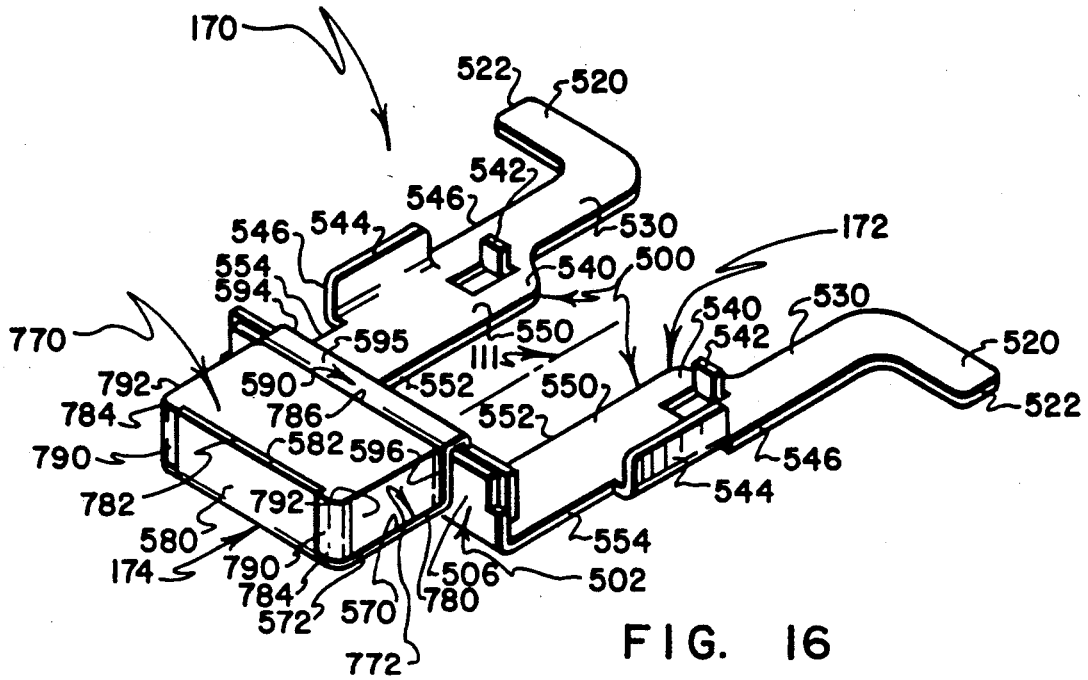
FIG. 16 is a perspective view, on an enlarged scale, of the plural-piece "first" slide embodiment of FIGS. 8 and 9; and, FIG. 11 is a perspective view similar to FIG. 16 but showing a plural-piece "third" slide embodiment that is formed by eliminating one of the plurality of component parts that forms the "first" slide embodiment.

Referring to FIGS. 5 and 16, in accordance with the most preferred practice of the present invention the plural-piece slide embodiment 170 includes (in addition to the aforedescribed first and second stamped metal parts 172, 174) a third part that takes the form of a rigid block 770 of plastic material, typically injection molded nylon. The block 770 is carried in a three-walled "pocket" 772 that is defined by the small stamping 174. The spaced wall formations 582, 596 cooperate with the wall portion 570 to define the three-walled "pocket" 772.

Referring to FIGS. 5 and 16, the block 770 has central portions that are configured to be received closely by and to fit snugly within the "pocket" 772 of the small stamping 174. In this regard, the block 770 has a bottom wall 780 that is configured to overlie and to extend in substantially contiguous engagement with the flat central wall portion 570 of the stamping. Likewise, the block 770 has transversely extending walls 782, 786 that extend in juxtaposition with the aforedescribed flange and wall portions 582, 596 that extend upwardly from opposed ends of the central portion 570 of the stamping 174.

The block 770 can be securely retained within the "pocket" 772 by any of a number of conventional techniques of fastening. In preferred practice, however, such retention is effected by assuring that the walls 782, 786 are properly spaced one from another so that, when the block 770 is pressed into the "pocket" 772, the walls 782, 786 are securely clampingly engaged by the flange and wall portions 582, 596 of the stamping 174.

The block 770 has a pair of corner formations 784 that are defined in part by end surface portions 790 that extend in a common plane with the end surface 580, and by opposed side surface portions 792 that extend in common planes with the aforedescribed side surfaces 572 of the stamping 174. By this arrangement: 1) the end surface portions 790 provide contiguous extensions of the end surface 580; 2) the side surface portions 792 provide contiguous extensions of the opposed side surfaces 572; 3) the corner formations 784 extend along and closely engage opposite ends of the upturned flange 582 to help to "lock" the block 770 in place within the "pocket" 772; and, 4) the transversely extending wall 786 of the block 770 is held in closely fitting engagement with the wall 596 that clampingly engages the surface 506 of the bridging leg or "central region" 502 of the large stamping 172—whereby the block 770 not only assists the wall 596 in structurally reinforcing the bridging leg or "central region" 502 of the large stamping 172, but also helps to strengthen and maintain shape stability of the small stamping 174.

Figure 17:
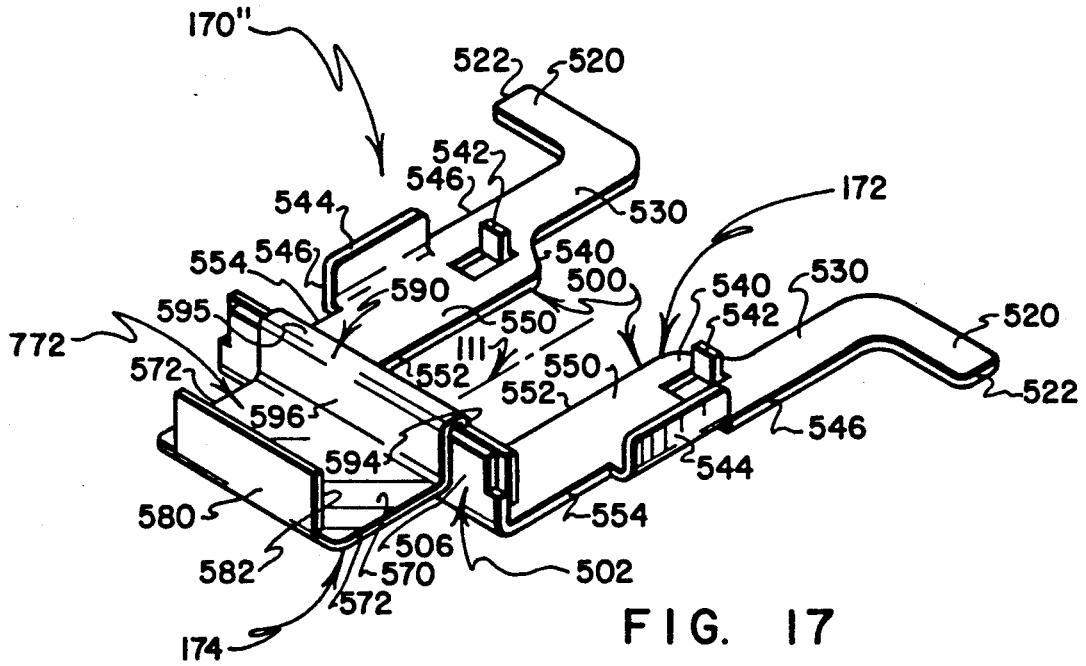

Referring to FIG. 17, a less preferred two-piece slide embodiment 170″ is depicted. As will readily be apparent from comparing the three-piece slide assembly 170 that is shown in FIG. 16 with the two-piece slide assembly 170″ that is shown in FIG. 17, the only difference between the embodiments 170, 170″ has to do with whether the "pocket" 772 does or does not carry the aforedescribed plastic block 770. While the two-piece slide embodiment 170″ (which does not utilize the block 770 as one of its component parts) provides adequate strength and shape-stability to permit its being utilized in a number of applications of the door lock 100, the three-piece embodiment 170 (which includes the block 770 as one of its three component parts) provides a stronger and more shape-stable slide for use with the door lock 100, whereby the three-piece embodiment 170 is preferred.

Referring to FIGS. 5, 6 and 14, the torsion coil spring 175 has a central coil winding 176 formed from spring wire, with opposed end regions 178 of the spring wire extending in generally opposite directions. The central coil winding 176 is installed about an upstanding post formation 179 that forms a part of the first housing member 110. The end regions 178 extend into engagement with the small, upwardly turned tabs 542 or 542′ of such one of the slide embodiments 170, 170′, 170″ as has been selected for use in the lock assembly 100—and serves to bias the selected slide embodiment 170, 170′, 170″ toward its latching position (shown typically in FIG. 6). When the selected slide embodiment 170, 170′ moves to its un latching position (shown typically in FIG. 14), this movement is carried out in opposition to the biasing action of the spring 175 and causes the end regions 178 of the spring 175 to be deflected leftwardly (as will be noted by comparing the configuration of the spring 175 as it is shown in FIGS. 6 and 14).

The operator members 190 are identical one with another, but are positioned in back-to-back relationship with their hub portions 684 extending in opposite directions for being journaled by separate ones of the housing holes 284, 384. By this arrangement, the operator members 190 are permitted to move independently relative to each other so that the opposed, wing-like arm portions 688 that form parts of each of the operator members 190 can be brought separately into engagement with the selected slide embodiment 170, 170′, 170″ to effect unlatching movement of the selected slide embodiment 170, 170′, 170″ in opposition to the action of the torsion coil spring 175.

The hub portions 684 of the operator members 190 each have relatively square connection formations 690 that are defined therein so as to permit each of the operator members 190 to be "operated" by a separate control linkage (such as the handle-operated linkages 74, 75 that are depicted in FIG. 2 wherein each of the bell-crank members 84, 85 is intended to be connected in a conventional manner to a separate one of the lock operator members 190, for example by suitable stub shaft formations, not shown).

Referring briefly to FIGS. 12 and 13, a preferred form of keeper 900 for use with the lock assembly 100 is formed as a one-piece casting that has a mounting flange 902 that is provided near opposite ends thereof with slotted holes 904 for receiving fasteners (not shown) to mount the keeper 900 on suitable parts of a door frame or other structure so as to be duly engaged by an associated one of the lock assemblies 100 when a closure on which the lock assembly 100 is mounted is moved to a closed position.

Projecting in cantilever fashion from a center portion of the mounting flange 902 is a toothed-surface type of latch-engaging formation that is indicated generally by the numeral 906. The formation 906 has a relatively thin rearwardly-extending web 908, tapered frontal surface portions 910, and two pairs of tooth-like formations 912 that are located intermediate the rearwardly-extending web 908 and the tapered frontal portions 910.

When the lock assembly 100 is moved into latching engagement with the keeper 900, the tapered distal end regions 160 of the latch members 150 are brought into abutting engagement with the tapered frontal surface portions 910 and are thereby caused to be wedged apart (i.e., the latch members 150 are caused to retract into the passages 700 as the tapered distal end regions 160 of the latch members 150 ride across the pairs of tooth-like formations 912, with the distal end regions 160 preferably coming to a final position of latched engagement at a location behind the tooth-like formations 912 wherein the end regions 160 extend substantially into gripping relationship with the rearwardly-extending web 908.

While the keeper 900 that is depicted in FIGS. 12 and 13 embodies the preferred form of keeper for use with the lock assembly 100, those who are skilled in the art will readily understand that a wide range of other keeper configurations can be used with the lock assembly 100.

In view of the biasing action of the springs 175, 195, the latch members 150 and other components of the lock assembly 100 normally assume the positions that are depicted in FIG. 6. When the lock assembly components are in the positions that are shown in FIG. 6, the tapered, distal end regions 160 of the latch members 150 are ready to engage a suitably configured keeper 900 in the manner that has been described. Moreover, when the lock assembly 100 has been brought into properly latched engagement with a suitably configured keeper, such as the aforedescribed keeper 900 (whereby, for example, the rearwardly extending web 908 of the keeper 900 is positioned between the distal ends 160 of the latch members 150), the latched positions of the components of the lock assembly 100 also corresponds to the component positions that are depicted in FIG. 6.

When either one of the operator members 190 is rotated to an unlatching position (to effect corresponding movements of the associated slide embodiment 170, 170' or 170" and to effect unlatching movements of the latch members 150 such as is depicted in FIG. 14), the distal ends 160 of the latch members 150 retract into the opposed passages 700 so as to release their engagement with the keeper 900, and so as to permit the keeper 900 to be fully withdrawn from the keeper-receiving passage 800. By this method, the lock assembly 100 is caused to "unlatch."

While the described slide embodiments 170, 170', 170" are essentially of "interchangeable" character, one advantage that does obtain with the use of either of the plural-piece slide embodiments 170, 170" (that does not obtain with the use of the one-piece slide embodiment 170') is that the U-shaped clip portion 590 of the smaller component 174 serves to reinforce the bridging wall or "central portion" 502 of the larger component 172—whereby, if excessive force is caused to be applied by forcing one of the winged end regions 688 of one of the lock operators 190 into engagement with the reinforced bridging wall or "central portion" 502, the two-piece slide embodiments 170, 170" may tend to better resist such an application of force and may therefore tend to enhance the force-resistant nature of the lock assembly 100.

As will be apparent from the foregoing discussion taken in conjunction with the accompanying drawings and the claims that follow, the present invention provides a novel and improved lock assembly that not only draws upon some of the proven features which form the subject matter of the referenced Prior Utility and Prior Design patents, but also provides a lock assembly that can be fabricated utilizing a lesser number of complexly configured components, and that makes good use of a number of components that are formed relatively simply as stampings from sheet metal.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axis that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions abut their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means includes a sheet metal stamping that is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means, with the first and second leg formations being substantially flat and extending in a substantially common plane that parallels said spaced, substantially parallel planes of the housing means except that, at locations midway along the lengths of the first and second leg formations, a first pair of upwardly turned, tab-like formations is provided for engaging the slide biasing means, and a second pair of upwardly turned, tab-like formations is provided for enhancing the area of contact between said edge surfaces of the first and second leg formations and a selected pair of said opposed slide-guide surfaces, and with the bridging leg extending in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage;

e) said selected one of the first and second housing members being formed as a substantially flat sheet metal stamping;

f) a portion of said selected housing member being pressed inwardly toward said other of the housing members to provide a substantially flat C-shaped surface portion that extends in a plane that is located inwardly relative to a plane in which a majority of the remainder of the portions of said selected housing member extend; and, g) said C-shaped surface portion overlying at least portions of the first and second wall portions that extend along opposite sides of the keeper-receiving passage so as to contribute to the definition of portions of the opposed first and second latch-member-receiving passages.

2. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axis that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means includes a sheet metal stamping that is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means, with the first and second leg formations being substantially flat and extending in a substantially common plane that parallels said spaced, substantially parallel planes of the housing means except that, at locations midway along the lengths of the first and second leg formations, a first pair of upwardly turned, tab-like formations is provided for engaging the slide biasing means, and a second pair of upwardly turned, tab-like formations is provided for enhancing the area of contact between said edge surfaces of the first and second leg formations and a selected pair of said opposed slide-guide surfaces, and with the bridging leg extending in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage;

e) said other of the housing members having peripherally extending wall portions that are of a common "major thickness" that defines said "majority of thickness;"

f) a plurality of relatively small post-like formations being formed as integral portions of said other housing member;

g) said small post-like formations defining regional thickness of said other housing member that are greater than said "major thickness," whereby said small post-like formations project toward said selected housing member to an extent that goes beyond a plane that is defined by said portions that are of said "major thickness;" and, h) said selected housing member having openings formed therethrough so as to receive the small post-like formations so as to assist in maintaining a congruent orientation of the first and second housing members.

3. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages than open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means includes a sheet metal stamping that is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means, with the first and second leg formations being substantially flat and extending in a substantially common plane that parallels said spaced, substantially parallel planes of the housing means except that, at locations midway along the lengths of the first and second leg formations, a first pair of upwardly turned, tab-like formations is provided for engaging the slide biasing means, and a second pair of upwardly turned, tab-like formations is provided for enhancing the area of contact between said edge surfaces of the first and second leg formations and a selected pair of said opposed slide-guide surfaces, and with the bridging leg extending in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members to the definition of the opposed first and second wall portions that face toward each other and extend along opposite sides of the keeper-receiving passage; and, e) at least one small post-like formation is formed as an integral part of the casting that forms said selected housing member, said at least one small post-like formation has end portions that extend through a hole means formed in said other of said housing members, and said end portions are "staked" during assembly of the components of the lock assembly so as to provided headed formation means that assists in maintaining a clamped-together assembly of the first and second housing members.

4. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means includes a sheet metal stamping that is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means, with the first and second leg formations being substantially flat and extending in a substantially common plane that parallels said spaced, substantially parallel planes of the housing means except that, at locations midway along the lengths of the first and second leg formations, a first pair of upwardly turned, tab-like formations is provided for engaging the slide biasing means, and a second pair of upwardly turned, tab-like formations is provided for enhancing the area of contact between said edge surfaces of the first and second leg formations and a selected pair of said opposed slide-guide surfaces, and with the bridging leg extending in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage; and, e) reinforcing means connected to the bridging leg for enhancing the strength of the bridging leg.

5. The lock assembly of claim 4 wherein the slide means and the reinforcing means all comprise integral portions of the same one-piece member formed as a stamping from sheet metal.

6. The lock assembly of claim 4 wherein the slide means and the reinforcing means comprise separately formed, snap-together components stamped from sheet metal.

7. The lock assembly of claim 6 wherein the component that forms said reinforcing means provides gripping means of U-shaped cross-section that is configured so as to snugly sandwich major portions of the bridging leg between overlying surfaces of the U-shaped gripping means.

8. The lock assembly of claim 7 wherein the reinforcing means includes a rigid block of plastic material that is configured to extend alongside and to be held in firm engagement with said gripping means so as to provide reinforcement thereto.

9. The lock assembly of claim 6 wherein:

a) the separately formed, snap-together, stamped metal components include a first stamping formed from relatively thick sheet metal, with the first stamping defining said bridging leg as a single thickness of said relatively thick sheet metal; and, b) the separately formed, snap-together, stamped metal components also include a second stamping formed from relatively thin sheet metal, with the second stamping including connecting formation means for clampingly engaging said bridging leg including a pair of parallel-extending wall formations that are held in closely spaced relationship by an integrally formed connecting wall, with the parallel-extending wall formations being configured to securely clampingly grip opposite of said bridging leg when the bridging leg is inserted therebetween.

10. The lock assembly of claim 9 wherein:

a) the second stamping also includes wall formation means connected to said connecting formation means for defining a "pocket" capable of receiving and mounting a rigid block of material; and, b) rigidifying means including a rigid block of material configured to be snugly received within said "pocket" for extending closely alongside a plurality of surface areas of the second stamping to structurally rigidify the second stamping.

11. The lock assembly of claim 10 wherein the block of material extends snugly into engagement with one of the parallel extending wall formations of the connecting formation means to assist rigidifying the connection formation means.

12. The lock assembly of claim 11 wherein the block of material comprises a solid block of rigid plastic material such as nylon.

13. The lock assembly of claim 4 wherein:

a) the housing means has an end wall portion that bounds the second end region of the central chamber at a location near the center plane;

b) the reinforcing means includes sheet metal structure that joins with but extends away from the U-shaped bridging leg toward said end wall portion; and, c) a stop surface is defined by an end portion of said sheet metal structure for engaging said end wall portion when the slide means is at the full limit of its range of unlatching movement.

14. The lock assembly of claim 13 wherein the reinforcing means additionally includes rigidifying means in the form of a rigid block of material that extends between and snugly engages the reinforcing means and said end portion.

15. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means is defined, at least in part, by a sheet metal stamping;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage;

e) said selected one of the first and second housing members being formed as a substantially flat sheet metal stamping;

f) a portion of said selected housing member being pressed inwardly toward said other of the housing members to provide a substantially flat C-shaped surface portion that extends in a plane that is located inwardly relative to a plane in which a majority of the remainder of the portions of said selected housing member extend; and, g) said C-shaped surface portion overlying at least portions of the first and second wall portions that extend along opposite sides of the keeper-receiving passage so as to contribute to the definition of portions of the opposed first and second latch-member-receiving passages.

16. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means is defined, at least in part, by a sheet metal stamping;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage;

e) said other of the housing members having peripherally extending wall portions that are of a common "major thickness" that defines said "majority of thickness;"

f) a plurality of relatively small post-like formations being formed as integral portions of said other housing member;

g) said small post-like formations defining regional thicknesses of said other housing member that are greater than said "major thickness," whereby said small post-like formations project toward said selected housing member to an extend that goes beyond a plane that is defined by said portions that are of said "major thickness;" and, h) said selected housing member having openings formed therethrough so as to receive the small post-like formations so as to assist in maintaining a congruent orientation of the first and second housing members.

17. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means is defined, at least in part, by a sheet metal stamping;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage; and, e) at least one small post-like formation is formed as an integral part of the casting that forms said selected housing member, said at least one small post-like formation has end portions that extend through a hole means formed in said other of said housing members, and said end portions are "staked" during assembly of the components of the lock assembly so as to provided headed formation means that assists in maintaining a clamped-together assembly of the first and second housing members.

18. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means is defined, at least in part, by a sheet metal stamping;

d) a selected one of the first and second housing members is formed as a substantially flat sheet metal stamping while the other of the first and second housing members is formed as a cast metal part that provides the majority of the thickness of the resulting assembly of the first and second housing members, with both of the first and second housing members nonetheless contributing to the definition of the opposed first and second wall portions that face toward each other and extend along opposite sides of the keeper-receiving passage; and, e) the sheet metal stamping that forms at least part of said slide means is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means.

19. The lock assembly of claim 18 wherein the first and second leg formations are substantially flat and extend in a substantially common plane that parallels said spaced, substantially parallel planes of the housing means except that, at locations midway along the lengths of the first and second leg formations, a pair of upwardly turned, tab-like formations is provided for engaging the slide biasing means.

20. The lock assembly of claim 18 wherein the first and second leg formations are substantially flat and extend in a substantially common plane that parallels said spaced, substantially parallel planes of the housing means except that, at locations midway along the lengths of the first and second leg formations, a pair of upwardly turned, tab-like formations is provided for enhancing the area of contact between said edge surfaces of the first and second leg formations and a selected pair of said opposed slide-guide surfaces.

21. The lock assembly of claim 18 wherein the bridging leg extends in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis.

22. The lock assembly of claim 21 wherein the slide means and the reinforcing means all comprise integral portions of the same one-piece member formed as a stamping from sheet metal.

23. The lock assembly of claim 21 additionally including reinforcing means connected to the bridging leg for enhancing the strength of the bridging leg.

24. The lock assembly of claim 23 wherein the slide means and the reinforcing means comprise separately formed, snap-together components stamped from sheet metal.

25. The lock assembly of claim 24 wherein the component that forms said reinforcing means provides gripping means of U-shaped cross-section that is configured so as to snugly sandwich major portions of the bridging leg between overlying surfaces of the U-shaped gripping means.

26. The lock assembly of claim 25 wherein the reinforcing means includes a rigid block of plastic material that is configured to extend alongside and to be held in firm engagement with said gripping means so as to provide reinforcement thereto.

27. The lock assembly of claim 24 wherein:

a) the separately formed, snap-together, stamped metal components include a first stamping formed from relatively thick sheet metal, with the first stamping defining said bridging leg as a single thickness of said relatively thick sheet metal; and, b) the separately formed, snap-together, stamped metal components also include a second stamping formed from relatively thin sheet metal, with the second stamping including connecting formation means for clampingly engaging said bridging leg including a pair of parallel-extending wall formations that are held in closely spaced relationship by an integrally formed connecting wall, with the parallel-extending wall formations being configured to securely clampingly grip opposite of said bridging leg when the bridging leg is inserted therebetween.

28. The lock assembly of claim 27 wherein:

a) the second stamping also includes wall formation means connected to said connecting formation means for defining a "pocket" capable of receiving and mounting a rigid block of material; and, b) rigidifying means including a rigid block of material configured to be snugly received within said "pocket" for extending closely alongside a plurality of surface areas of the second stamping to structurally rigidify the second stamping.

29. The lock assembly of claim 28 wherein the block of material extends snugly into engagement with one of the parallel extending wall formations of the connecting formation means to assist rigidifying the connection formation means.

30. The lock assembly of claim 29 wherein the block of material comprises a solid block of rigid plastic material such as nylon.

* * * * *